US010910124B2

(12) United States Patent
Kim et al.

(10) Patent No.: US 10,910,124 B2
(45) Date of Patent: Feb. 2, 2021

(54) MANUFACTURING METHOD OF FOLDABLE TRANSPARENT ELECTRODE BASED ON FIBER, AND FOLDABLE TRANSPARENT ELECTRODE BASED ON FIBER THEREFROM

(71) Applicant: INDUSTRIAL COOPERATION FOUNDATION CHONBUK NATIONAL UNIVERSITY, Jeonju-si (KR)

(72) Inventors: Byoung Suhk Kim, Jeonju-si (KR); Seung Hee Lee, Jeonju-si (KR); In Chul Kim, Gyeryong-si (KR)

(73) Assignee: INDUSTRIAL COOPERATION FOUNDATION CHONBUK NATIONAL UNIVERSITY, Jeonju-si (KR)

( * ) Notice: Subject to any disclaimer, the term of this patent is extended or adjusted under 35 U.S.C. 154(b) by 0 days.

(21) Appl. No.: 16/092,506

(22) PCT Filed: Nov. 24, 2017

(86) PCT No.: PCT/KR2017/013528
§ 371 (c)(1),
(2) Date: Oct. 10, 2018

(87) PCT Pub. No.: WO2019/078406
PCT Pub. Date: Apr. 25, 2019

(65) Prior Publication Data

US 2020/0243212 A1 Jul. 30, 2020

(30) Foreign Application Priority Data

Oct. 16, 2017 (KR) ..... 10-2017-0134097

(51) Int. Cl.
*H01B 1/02* (2006.01)
*H01B 3/30* (2006.01)
*H01B 13/12* (2006.01)

(52) U.S. Cl.
CPC ..... *H01B 1/02* (2013.01); *H01B 3/30* (2013.01); *H01B 13/12* (2013.01)

(58) Field of Classification Search
CPC .. H01B 1/12; H01B 1/22; H01B 13/12; B32B 7/12

(Continued)

(56) References Cited

FOREIGN PATENT DOCUMENTS

JP 2005-317528 11/2005
JP 2007-270146 10/2007

(Continued)

OTHER PUBLICATIONS

I. C. Kim et al., "Extremely Foldable and Highly Transparent Nanofiber-Based Electrodes for Liquid Crystal Smart Devices", Scientific Reports, 8:11517, 2018.

(Continued)

*Primary Examiner* — Khanh T Nguyen
(74) *Attorney, Agent, or Firm* — Lex IP Meister, PLLC

(57) ABSTRACT

A foldable transparent electrode based on fiber and a manufacturing method thereof are provided. The manufacturing method of a foldable transparent electrode based on fiber according to the exemplary embodiment includes: coating a nylon-6 nanofiber nonwoven fabric with a polymer to prepare a nylon-6 nanofiber transparent thin film, and spin coating the nylon-6 nanofiber transparent thin film with a silver nanowire solution.

6 Claims, 11 Drawing Sheets

(58) Field of Classification Search
USPC ..... 428/368
See application file for complete search history.

(56) References Cited

FOREIGN PATENT DOCUMENTS

| | | | | | |
|---|---|---|---|---|---|
| JP | 2012-241017 | | | 12/2012 | |
| KR | 10-2009-0022983 | | | 3/2009 | |
| KR | 10-2010-0105179 | | | 9/2010 | |
| KR | 10-2013-0075566 | | | 7/2013 | |
| KR | 10-1402851 | | | 6/2014 | |
| KR | 10-2015-0070468 | | | 6/2015 | |
| KR | 10-1572194 | | | 11/2015 | |
| KR | 10-1595895 | | | 2/2016 | |
| KR | 10-2016-0118415 | | | 10/2016 | |
| KR | 20160118415 | A | * | 10/2016 | ..... H01B 1/12 |
| KR | 10-2016-0136605 | | | 11/2016 | |
| KR | 20160136605 | A | * | 11/2016 | ..... H01B 1/22 |
| KR | 10-2017-0074207 | | | 6/2017 | |
| KR | 20170074207 | A | * | 6/2017 | ..... B32B 7/12 |

OTHER PUBLICATIONS

WIPO, A PCT Search Report of PCT/KR2017/013528 dated Jul. 12, 2018.
WIPO, A PCT Written Opinion of PCT/KR2017/013528 dated Jul. 12, 2018.

* cited by examiner

FIG. 7

| | Young's modulus (MPa) | Tensile strength (MPa) | Toughness (kN/mm) |
|---|---|---|---|
| Cellulose (CA) | 192.7 | 16.2 | 65.7 |
| NF-r-CA 15 | 756.9 | 29.4 | 134.1 |
| NF-r-CA 30 | 794.4 | 43.02 | 262.53 |
| NF-r-CA 45 | 914.9 | 59.66 | 586.0 |

| | NF | NF-r-CA | NF-r-CA electrodes |
|---|---|---|---|
| $R_{RMS}$(nm) | 331 | 27 | 48 |

MANUFACTURING METHOD OF FOLDABLE TRANSPARENT ELECTRODE BASED ON FIBER, AND FOLDABLE TRANSPARENT ELECTRODE BASED ON FIBER THEREFROM

TECHNICAL FIELD

The present invention relates to a manufacturing method of a foldable transparent electrode based on fiber, and a foldable transparent electrode based on fiber therefrom.

BACKGROUND ART

Recently, a foldable transparent electrode receives attention in many wearable optoelectronic devices such as a touch screen, an organic light emitting diode (OLED), a solar cell and electronic skins (e-skins).

Basically, the foldable transparent electrode is required to have optical transparency, low electrical resistance, and extremely high flexural toughness without significantly decreased electrical performance. Generally, resistivity and optical transmittance show opposite tendencies. Therefore, for obtaining a transparent electrode having high conductivity, it is important to achieve optimal balance between electrical resistivity and optical transmittance.

Traditionally, a commercial indium-tin oxide (ITO) electrode has been widely used in a transparent conductive optoelectrical device. However, since the ITO electrode has demerits such as lack of indium, high cost of the manufacturing process and mechanical brittleness in a flexible electronic application field, it is known that studies using the following new materials for overcoming the demerits of the ITO electrode have been conducted. For example, up to date, promising flexible transparent electrode materials such as conductive polymers, carbon nanotubes (CNT), graphene, metal nanowires, metal nanotrough networks and fusion materials thereof have been used for manufacturing the flexible transparent electrode having low resistivity and high flexibility.

However, poly-based films such as PET and PEN which are used as a flexible substrate in most of transparent films have limitation in extreme bending of a bending radius within 1 mm.

CITATION LIST

Patent Literature

Korean Patent Registration No. 1572194 (registered on Nov. 20, 2015)

Korean Patent Registration No. 1595895 (registered on Feb. 15, 2016)

SUMMARY OF INVENTION

Technical Problem

The present invention is directed to providing a manufacturing method of a foldable transparent electrode based on fiber, and a foldable transparent electrode based on fiber therefrom.

Solution to Problem

An exemplary embodiment of the present invention provides a manufacturing method of a foldable transparent electrode based on fiber including: coating a nylon-6 nanofiber nonwoven fabric with a polymer to prepare a nylon-6 nanofiber transparent thin film; and spin coating the nylon-6 nanofiber transparent thin film with a silver nanowire solution.

In addition, a ratio of a refractive index of the polymer and a refractive index of a nylon-6 of the nylon-6 nanofiber nonwoven fabric may be 0.964 to 0.998:1.

In addition, the polymer may include polyvinyl acetate, cellulose acetate and polyacrylic acid.

In addition, the step of spin coating the nanowire on the nylon-6 nanofiber transparent thin film may include forming an adhesive layer on the nylon-6 nanofiber transparent thin film, and spin coating the nanowire on the adhesive layer.

In addition, a silver nanowire in the silver nanowire solution may be contained at 0.025 wt % to 0.05 wt %.

Another exemplary embodiment of the present invention provides a foldable transparent electrode based on fiber.

Specific matters of the present invention will be included in a detailed description and the accompanying drawings.

Advantageous Effects of Invention

According to an aspect of the present invention, a manufacturing method of a foldable transparent electrode based on fiber having excellent optical transmittance and mechanical properties may be provided.

According to another aspect of the present invention, a foldable transparent electrode based on fiber having excellent optical transmittance and mechanical properties may be provided.

BRIEF DESCRIPTION OF DRAWINGS

FIG. 7 is a table representing a young's modulus, tensile strength and toughness of a nylon-6 nanofiber transparent thin film depending on electrospinning time, according to an exemplary embodiment of the present invention.

DESCRIPTION OF EMBODIMENTS

Figure 1:
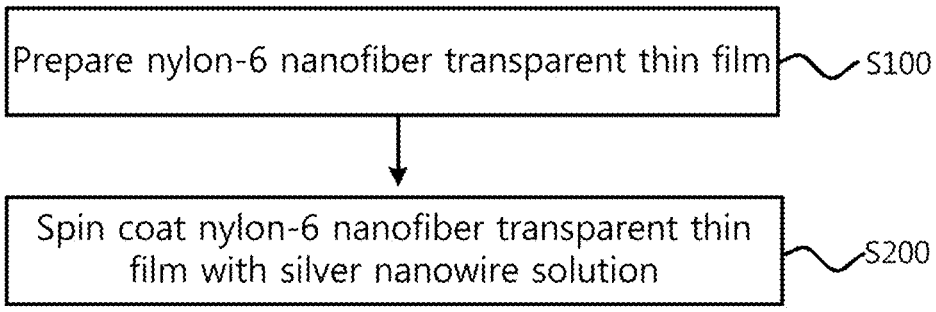
FIG. 1 is a flow chart representing a manufacturing method of a foldable transparent electrode based on fiber according to an exemplary embodiment of the present invention.

Hereinafter, exemplary embodiments of the present invention will be described in detail with reference to the accompanying drawings so that those skilled in the art may easily practice the present invention. However, the present invention may be implemented in various different forms and is not limited to the embodiments provided in the present description. In the drawings, portions unrelated to the description will be omitted in order to clearly describe the present invention, and throughout the specification, identical reference numerals designate identical or like elements.

Hereinafter, the present invention will be described in detail with reference to the accompanying drawings.

Figure 2:
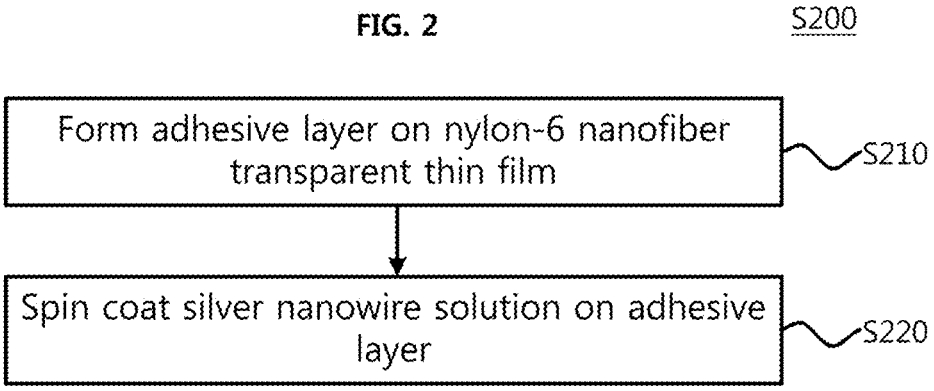
FIG. 2 is a flow chart representing a step of spin coating a nylon-6 nanofiber transparent thin film with a silver nanowire solution, according to an exemplary embodiment of the present invention.

FIG. 1 is a flow chart representing a manufacturing method of a foldable transparent electrode based on fiber, according to an exemplary embodiment of the present invention, and FIG. 2 is a flow chart representing a step of spin coating a nylon-6 nanofiber transparent thin film with a silver nanowire solution, according to an exemplary embodiment of the present invention.

Referring to FIG. 1, the manufacturing method of a foldable transparent electrode based on fiber according to the exemplary embodiment includes preparing a nylon-6 nanofiber transparent thin film having optical transmittance of 85% or more (S100), and spin coating the nylon-6 nanofiber transparent thin film with a silver nanowire solution (S200).

Here, the step of spin coating the nylon-6 nanofiber transparent thin film (S200) with the silver nanowire solution may include forming an adhesive layer on the nylon-6 nanofiber transparent thin film (S210), and spin coating the nanowire on the adhesive layer (S220).

The nylon-6 nanofiber transparent thin film according to the exemplary embodiment may be prepared by coating a nylon-6 nanofiber nonwoven fabric with a polymer.

According to the exemplary embodiment, the nylon-6 nanofiber nonwoven fabric may be immersed in a polymer in a solution state, or the polymer in a solution state is sprayed onto the nylon-6 nanofiber nonwoven fabric, thereby coating the polymer on the nylon-6 nanofiber nonwoven fabric.

In addition, the nylon-6 nanofiber nonwoven fabric according to the exemplary embodiment may be prepared by electrospinning a nylon-6 solution. A preparation method of the nylon-6 fiber nonwoven fabric will be described in detail in the following exemplary embodiment in detail.

According to the exemplary embodiment, a ratio of a refractive index of the polymer coated on the nylon-6 nanofiber nonwoven fabric and a refractive index of the nylon-6 may be 0.964 to 0.998:1.

In addition, the polymer according to the exemplary embodiment may include poly(vinyl acetate), cellulose acetate, and poly(acrylic acid).

According to the exemplary embodiment, when the ratio of the refractive index of nylon-6 and the refractive index of the polymer is 0.964 to 0.998:1, the optical transmittance of the nylon-6 nanofiber transparent thin film may be significantly improved, as compared with the optical transmittance of the nylon-6 nanofiber nonwoven fabric.

Hereinafter, the relation between the ratio of the refractive index of the polymer and the refractive index of the nylon-6, and the optical transmittance will be described in detail.

TABLE 1

Refractive index of polymer

| | Polymer | Refractive index |
|---|---|---|
| 1 | Nylon-6 | 1.53 |
| 2 | Poly(vinylidene fluoride) | 1.42 |
| 3 | Poly(vinyl acetate) | 1.467 |
| 4 | Cellulose acetate | 1.475 |
| 5 | Poly(acrylic acid) | 1.527 |
| 6 | Polystyrene | 1.589 |

Referring to Table 1, the refractive index of nylon-6 is 1.53, the refractive index of poly(vinylidene fluoride) is 1.42, the refractive index of poly(vinyl acetate) is 1.467, the refractive index of cellulose acetate is 1.475, the refractive index of poly(acrylic acid) is 1.527, and the refractive index of polystyrene is 1.589.

Figure 3:
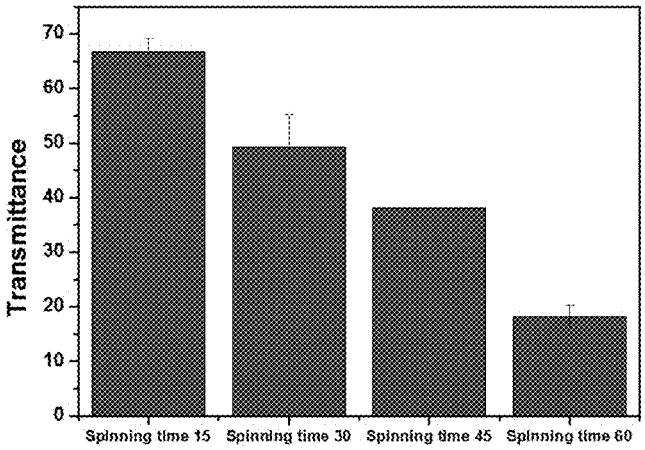
FIG. 3 is a graph representing optical transmittance of a nylon-6 nanofiber nonwoven fabric depending on electrospinning time, according to an exemplary embodiment of the present invention.

FIG. 3 is a graph representing optical transmittance of a nylon-6 nanofiber nonwoven fabric depending on electrospinning time, according to an exemplary embodiment of the present invention.

The optical transmittance of the nylon-6 nanofiber nonwoven fabric according to the exemplary embodiment was measured by UV-visible spectroscopy.

Referring to FIG. 3, the longer the electrospinning time for preparing the nylon-6 nanofiber nonwoven fabric, the lower the optical transmittance of the nylon-6 nanofiber nonwoven fabric.

Specifically, the optical transmittance of the nylon-6 nanofiber nonwoven fabric is about 66% when the electrospinning time is 15 minutes, about 50% when the electrospinning time is minutes, about 38% when the electrospinning time is 45 minutes, and about 15% when the electrospinning time is 60 minutes, and thus, the longer the electrospinning time, the lower the optical transmittance of the nylon-6 nanofiber nonwoven fabric.

Hereinafter, a polymer which significantly improves the optical transmittance of the nylon-6 nanofiber transparent thin film, as compared with the optical transmittance of the nylon-6 nanofiber nonwoven fabric, and a correlation between the improvement of the optical transmittance and the refractive index.

Figure 4:
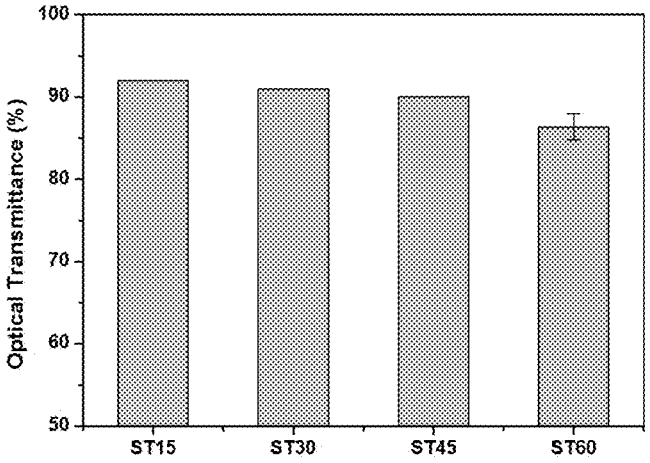
FIG. 4 is a graph representing optical transmittance of a nylon-6 nanofiber transparent thin film coated with cellulose acetate, according to an exemplary embodiment of the present invention.

FIG. 4 is a graph representing optical transmittance of a nylon-6 nanofiber transparent thin film coated with cellulose acetate, according to an exemplary embodiment of the present invention.

Referring to FIG. 4, each of the nylon-6 nanofiber nonwoven fabrics, prepared by electrospinning the nylon-6 for 15 minutes, 30 minutes, 45 minutes and 60 minutes was coated with cellulose acetate, and then the optical transmittance was measured.

According to the exemplary embodiment, the optical transmittance of the nylon-6 nanofiber transparent thin film coated with cellulose acetate was measured as 92% or less at 86% or more, which was improved by 1.4 to 5.7 times, as compared with the optical transmittance of the nylon-6 nanofiber nonwoven fabric (see FIG. 3).

Specifically, the optical transmittance of the nylon-6 nanofiber nonwoven fabric prepared by electrospinning for 15 minutes was 66% (see FIG. 3), and the optical transmittance of the nylon-6 nanofiber transparent thin film obtained by coating the nylon-6 nanofiber nonwoven fabric prepared by electrospinning for 15 minutes with cellulose acetate was 92% (see FIG. 4), and thus, the ratio of the optical transmittance of the nylon-6 nanofiber nonwoven fabric and the optical transmittance of the nylon-6 nanofiber transparent thin film is 1:1.4. Therefore, according to the exemplary embodiment, the optical transmittance of the nylon-6 nanofiber transparent thin film was improved by about 1.4 times, as compared with the optical transmittance of the nylon-6 nanofiber nonwoven fabric.

In addition, the optical transmittance of the nylon-6 nanofiber nonwoven fabric prepared by electrospinning for 60 minutes was 15% (see FIG. 3), and the optical transmittance of the nylon-6 nanofiber transparent thin film obtained by coating the nylon-6 nanofiber nonwoven fabric prepared by electrospinning for 60 minutes with cellulose acetate was 86% (see FIG. 4), and thus, the ratio of the optical transmittance of the nylon-6 nanofiber nonwoven fabric and the optical transmittance of the nylon-6 nanofiber transparent thin film is 1:5.7. Therefore, according to the exemplary embodiment, the optical transmittance of the nylon-6 nanofiber transparent thin film was improved by about 5.7 times, as compared with the optical transmittance of the nylon-6 nanofiber nonwoven fabric.

Again, referring to Table 1, the ratio of the refractive index of nylon-6 and the refractive index of cellulose acetate is 1:0.964.

According to the exemplary embodiment, when the ratio of the refractive index of nylon-6 and the refractive index of cellulose acetate is 1:0.964, the optical transmittance was improved by 1.4 to 5.7 times, regardless of the electrospinning time of 15 minutes, 30 minutes, 45 minutes and 60 minutes.

Figure 5:
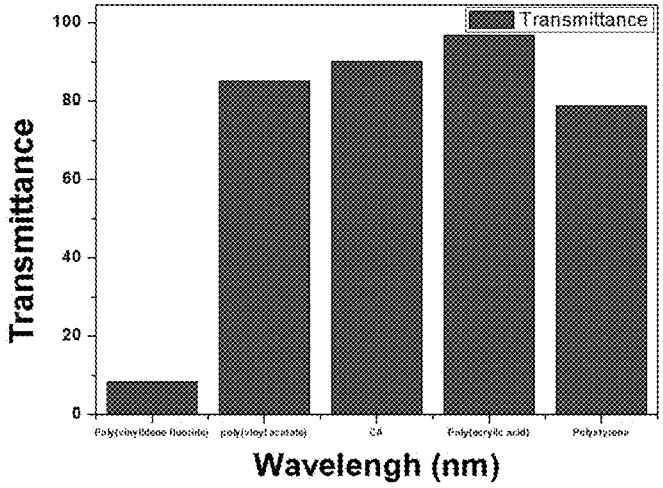
FIG. 5 is a graph representing optical transmittance of a nylon-6 nanofiber transparent thin film coated with various polymers, according to an exemplary embodiment of the present invention.

FIG. 5 is a graph representing optical transmittance of the nylon-6 nanofiber transparent thin film coated with polymers, according to an exemplary embodiment of the present invention.

The optical transmittance of the nylon-6 nanofiber transparent thin film according to the exemplary embodiment is preferably 85% or more, like the optical transmittance required for a general transparent electrode.

Referring to FIG. 5, the optical transmittance of each of the nylon-6 nanofiber transparent thin films obtained by coating the nylon-6 nanofiber nonwoven fabric prepared by electrospinning for 45 minutes with poly(vinylidene fluoride), poly(vinyl acetate), cellulose acetate, poly(acrylic acid) and polystyrene is 9%, 85%, 89%, 95% and 75%.

The optical transmittance of the nylon-6 nanofiber transparent thin film coated with poly(vinylidene fluoride) is 9%, and the optical transmittance of the nylon-6 nanofiber transparent thin film coated with polystyrene is 75%, which are lower than the optical transmittance required for a general transparent electrode.

In addition, the optical transmittance of the nylon-6 nanofiber transparent thin film coated with poly(vinyl acetate) is 85%, the optical transmittance of the nylon-6 nanofiber transparent thin film coated with cellulose acetate is 89%, and the optical transmittance of the nylon-6 nanofiber transparent thin film coated with poly(acrylic acid) is 95%, which are identical to or higher than the optical transmittance required for a general transparent electrode (85%).

Again, referring to Table 1, the refractive index of poly (vinylidene fluoride) is 1.42, and the refractive index of polystyrene is 1.589, wherein these compounds are coated on the nylon-6 nanofiber transparent thin film showing lower optical transmittance than the optical transmittance required for a general transparent electrode (85%).

However, the refractive index of poly(vinyl acetate) is 1.467, and the refractive index of cellulose acetate is 1.475, and the refractive index of poly(acrylic acid) is 1.527, the compounds being coated on the nylon-6 nanofiber transparent thin film showing the optical transmittance identical to or higher than the optical transmittance required for a general transparent electrode (85%). Here, the ratio of the refractive index of cellulose acetate and poly(acrylic acid), and the refractive index of nylon-6 is 0.964 to 0.998:1.

According to the exemplary embodiment, when the ratio of the refractive index of the polymer coated on the nylon-6 nanofiber transparent thin film and the refractive index of nylon-6 is 0.964 to 0.998:1, the optical transmittance of the nylon-6 nanofiber transparent thin film may be 85% or more.

In addition, the silver nanowire in the silver nanowire solution according to an exemplary embodiment of the present invention may be 0.025 wt % to 0.05 wt %.

Therefore, according to the exemplary embodiment, a manufacturing method of a foldable transparent electrode based on fiber having excellent mechanical properties such as a young's modulus, tensile strength and toughness, and a foldable transparent electrode based on fiber therefrom may be provided.

Experimental Examples

1. Preparation of Nylon-6 Nanofiber Transparent Thin Film

First, a nylon-6 solution including 6 wt % of nylon-6 was electrospinned at 9 to 10 kV for 15 to 60 minutes to prepare a nylon-6 nanofiber nonwoven fabric. The thus-prepared nylon-6 nanofiber nonwoven fabric was coated with a cellulose acetate solution including 10 wt % of cellulose acetate.

Here, the polymer coated on the nylon-6 nanofiber nonwoven fabric is not limited to cellulose acetate, and may be another polymer having a refractive index so that a ratio of the refractive index with nylon-6 of 0.964 to 0.998:1. For example, the polymer coated on the nylon-6 nanofiber nonwoven fabric may include polyvinyl acetate, cellulose acetate and polyacrylic acid.

2. Preparation of Foldable Transparent Electrode Based on Fiber

First, a silver nanowire aqueous solution including 0.1 wt % to 0.05 wt % of a silver nanowire was spin coated on the nylon-6 nanofiber transparent thin film piece.

Here, before spin coating the silver nanowire aqueous solution on the nylon-6 nanofiber transparent thin film piece, an adhesive layer may be formed on the nylon-6 nanofiber transparent thin film piece, and the silver nanowire aqueous solution may be spin coated.

In addition, when a plurality of the silver nanowire aqueous solutions having different wt % is spin coated on each of the adhesive layers formed in plural layers, the silver nanowire is uniformly spread on the nylon-6 nanofiber transparent thin film piece, and may be well-interconnected.

3. Mechanical Properties of Nylon-6 Nanofiber Transparent Thin Film

Figure 6:
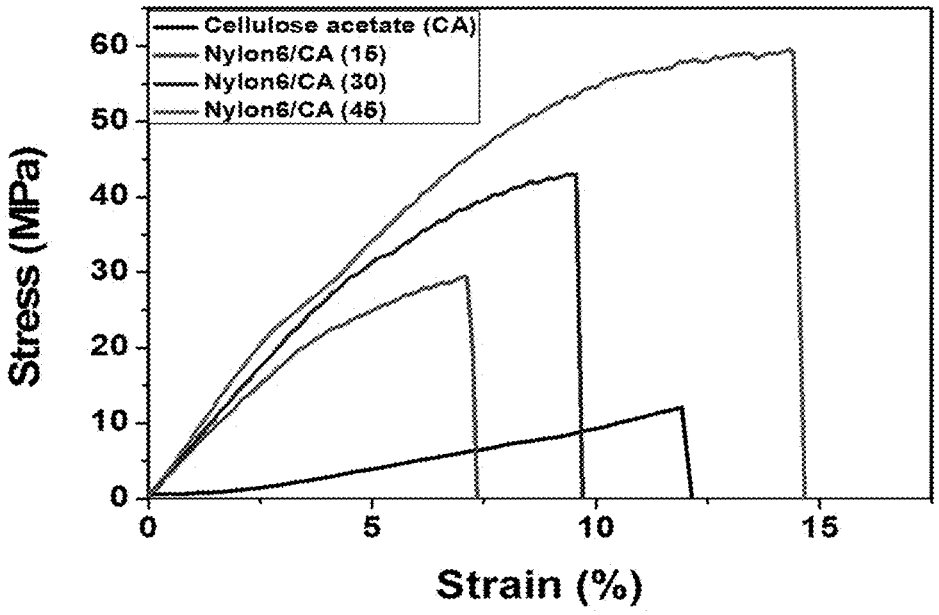
FIG. 6 is a graph representing stress-strain of a cellulose acetate pure film, and a nylon-6 nanofiber transparent thin film coated with cellulose acetate, according to an exemplary embodiment of the present invention.

FIG. 6 is a graph representing stress-strain of a cellulose acetate film, and a nylon-6 nanofiber transparent thin film coated with cellulose acetate, according to an exemplary embodiment of the present invention.

Referring to FIG. 6, the stress strain of the cellulose acetate film shows linear elastic deformation which is unique to thermoplastic elastomer. However, on the stress strain of the nylon-6 nanofiber transparent thin film coated with cellulose acetate, the mechanical properties of the materials are well reflected, and thus, as the nanofiber spinning time is longer (that is, as the content of the nanofiber content is increased), the mechanical properties is higher. For example, as the electrospinning time was increased to 15 minutes, 30 minutes, and 45 minutes, so that the amount of the nanofiber is increased, the tensile strength of the nylon-6 nanofiber transparent thin film coated with cellulose acetate was increased to 29.4 MPa, 43 MPa and 60 MPa.

FIG. 7 is a table representing a young's modulus, tensile strength and toughness of a nylon-6 nanofiber transparent thin film depending on electrospinning time, according to an exemplary embodiment of the present invention.

Referring to FIG. 7, the young's modulus, tensile strength and toughness of the nylon-6 nanofiber transparent thin film are varied with the amount of the nanofiber depending on the electrospinning time.

4. Surface Shape and Optical Transmittance Change

Figure 8:
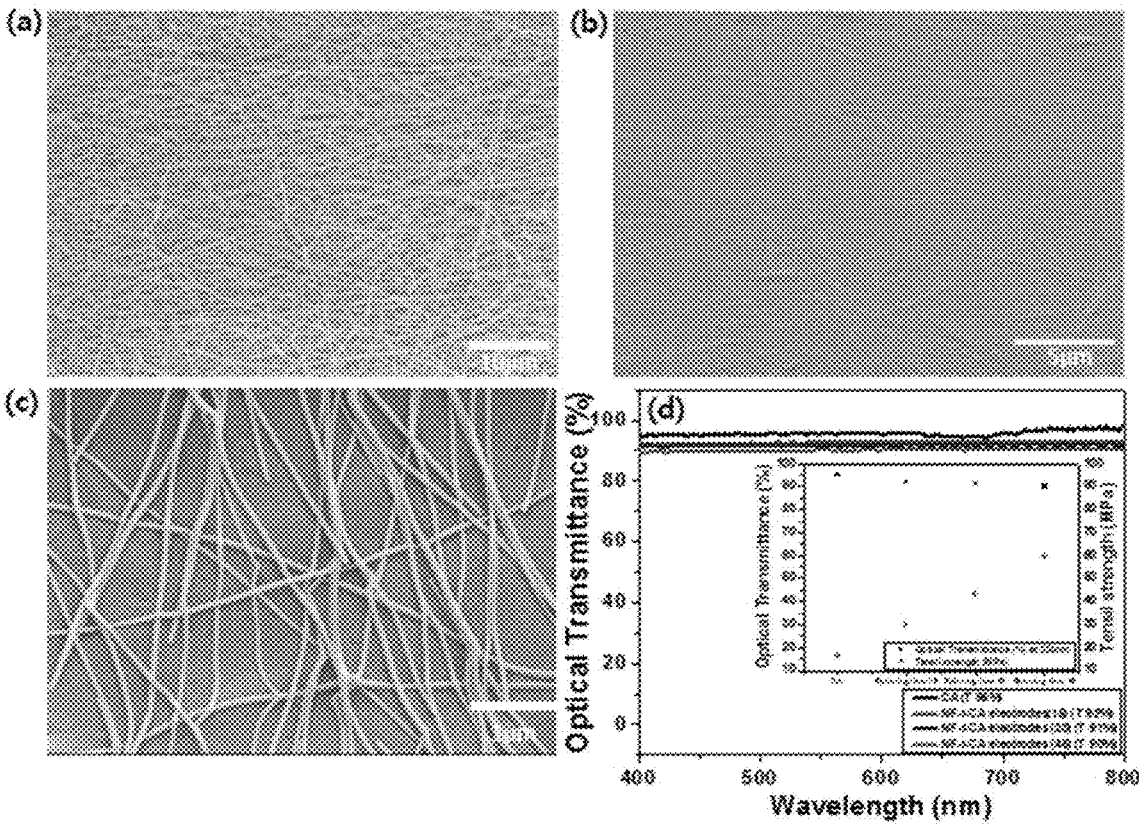
FIG. 8 is (a) an electron microscope image of the nylon-6 nanofiber nonwoven fabric, (b) an electron microscope image of the nylon-6 nanofiber transparent thin film coated with cellulose acetate, (c) an electron microscope image of the foldable transparent electrode based on fiber with the surface coated with a silver nanowire, and (d) a graph representing optical transmittance of a cellulose acetate pure film and the nylon-6 nanofiber transparent thin film depending on electrospinning time, according to an exemplary embodiment of the present invention.

FIG. 8 is (a) an electron microscope image of a nylon-6 nanofiber nonwoven fabric, (b) an electron microscope image of a nylon-6 nanofiber transparent thin film, (c) an electron microscope image of a foldable transparent electrode based on fiber coated with a silver nanowire, and (d) a graph representing optical transmittance of a cellulose acetate pure film, and the nylon-6 nanofiber transparent thin film depending on electrospinning time, according to an exemplary embodiment of the present invention.

Referring to (a) of FIG. 8, the surface of the nylon-6 nonwoven fabric including nanofiber having an average diameter of 120±25 nm shows a shape of non-oriented and disorderly arranged nanofiber.

However, referring to (b) of FIG. 8, the surface of the nylon-6 nanofiber transparent thin film coated with cellulose acetate shows a smooth shape, and thus, it was found that cellulose acetate is successfully penetrated between the nano fibers.

Referring to (c) of FIG. 8, it was found that the silver nanowire was coated on the surface of the nylon-6 nanofiber transparent thin film.

Since the nanofiber nonwoven fabric prepared by electrospinning scatters light in a space between disorderly arranged nanofibers, the light is not transmitted.

However, referring to (d) of FIG. 8, when pores of the nanofiber are filled with a polymer (e.g., cellulose acetate, refractive index of 1.48) having a similar refractive index to the nanofiber (e.g., Nylon-6, refractive index of 1.53), the optical transmittance is improved up to 90 to 92%.

Here, the polymer having a similar refractive index to nylon-6 is not limited to cellulose acetate, and may be another polymer having a refractive index so that a ratio of the refractive index with nylon-6 of 0.964 to 0.998:1.

Figure 9:
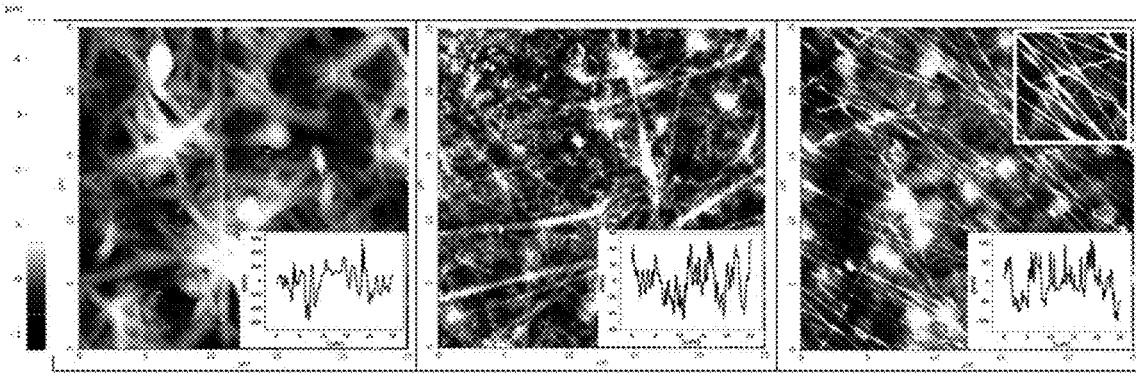
FIG. 9 is (a) an atomic force microscope image of the nylon-6 nanofiber nonwoven fabric, (b) an atomic force microscope image of the nylon-6 nanofiber transparent thin film coated with cellulose acetate, and (c) an atomic force microscope image of the foldable transparent electrode based on fiber, according to an exemplary embodiment of the present invention.

FIG. 9 is (a) an atomic force microscope image of the nylon-6 nonwoven fabric, (b) an atomic force microscope image of the nylon-6 nanofiber transparent thin film coated with cellulose acetate, and (c) an atomic force microscope image of the foldable transparent electrode based on fiber, according to an exemplary embodiment of the present invention.

Referring to FIG. 9, according to (a) the atomic force microscope image of the nylon-6 nonwoven fabric, the surface roughness ($R_{RMS}$) is about 331 nm, and according to (b) the atomic force microscope image of the nylon-6 nanofiber transparent thin film coated with cellulose acetate, the surface roughness ($R_{RMS}$) is about 27 nm, and thus, it was found that cellulose acetate is successfully penetrated into the pores of the nylon-6 nonwoven fabric. In addition, according to (c) the atomic force microscope image of the foldable transparent electrode based on fiber, it was found that the surface roughness ($R_{RMS}$) was not changed much from the surface roughness ($R_{RMS}$) of the nylon-6 nanofiber transparent thin film.

Figure 10:
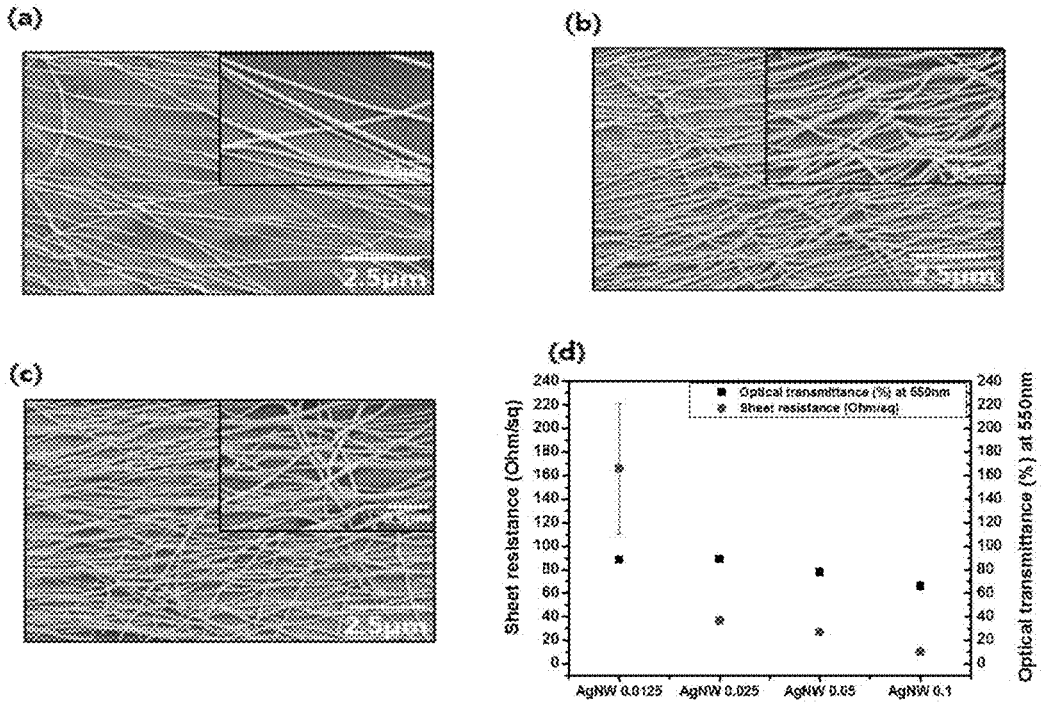
FIG. 10 is electron microscope images depending on wt % of the silver nanowire and an image representing optical transmittance, according to an exemplary embodiment of the present invention.

FIG. 10 is electron microscope images depending on wt % of the silver nanowire and a graph representing optical transmittance, according to an exemplary embodiment of the present invention.

Referring to (a) to (c) of FIG. 10, it was found that the silver nanowire is firmly attached on the surface of the nylon-6 nanofiber transparent thin film made of the nylon-6 nanofiber nonwoven fabric prepared by electrospinning for 45 minutes, whereby it is difficult to easily remove the silver nanowire from the surface by physical force such as bending or distortion.

Referring to (d) of FIG. 10, it was found that as the wt % of the silver nanowire is increased, the optical transmittance is decreased. For example, when the silver nanowire is contained at 0.1 wt %, the sheet resistance is decreased to 9 $\Omega \cdot sq^{-1}$, and the optical transmittance is sharply decreased to 23%. However, when the silver nanowire is contained at 0.025 wt % to 0.05 wt %, it was found that the sheet resistance is 32 $\Omega \cdot sq^{-1}$ to 25 $\Omega \cdot sq^{-1}$, and the optical transmittance is 85% to 90%.

However, when the silver nanowire is contained at 0.0125 wt %, the optical transmittance is 90%, but the sheet resistance was measured as 167 $\Omega \cdot sq^{-1}$, which is unduly high for use as a transparent electrode. In addition, when the silver nanowire is contained at 0.1 wt %, the sheet resistance is 9 $\Omega \cdot sq^{-1}$, but the optical transmittance was measured as 63% which is unduly low for use as a transparent electrode.

As a result, according to the exemplary embodiment, it was found that the wt % of the silver nanowire for satisfying the optical transmittance (85% or more) and the sheet resistance required for a general transparent electrode should be 0.025 wt % to 0.05 wt %.

Figure 11:
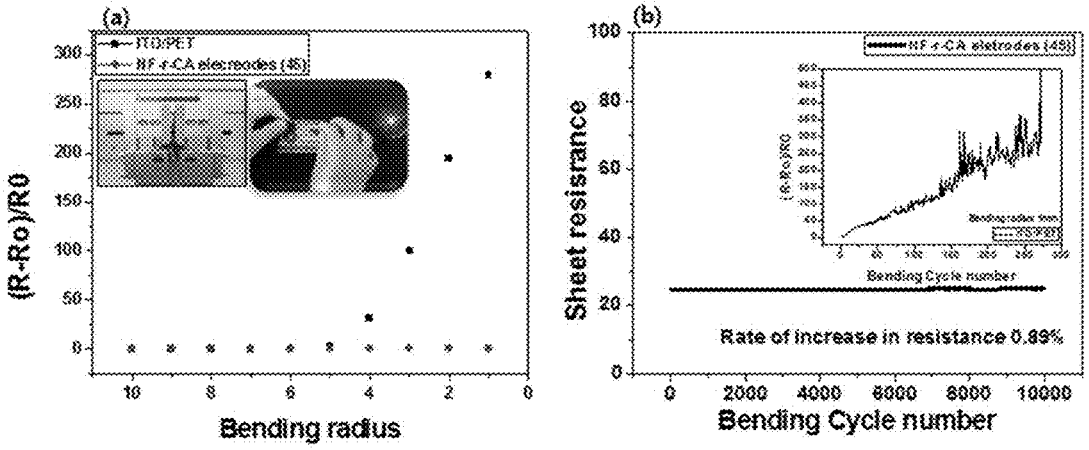
FIG. 11 is images of (a) a change of sheet resistivity relative to a bending radius of the foldable transparent electrode based on fiber, and (b) a result of a repetitive bending experiment of 10,000 cycles.

FIG. 11 is images of (a) a change of sheet resistivity relative to a bending radius of a foldable transparent electrode based on fiber, and (b) a result of a repetitive bending experiment of 10,000 cycles.

Referring to (a) of FIG. 11, the relative change of the sheet resistivity relative to the bending radius of the foldable transparent electrode based on fiber may be represented by $(R-R_o)/R_o$. Here, R is a resistance value after bending, and $R_0$ is a resistance value before bending. It was found that the foldable transparent electrode based on fiber according to the exemplary embodiment showed excellent mechanical flexibility even after extreme bending of a bending radius of 1 mm, however, the conventional ITO electrode had a sharply increased sheet resistance after a bending radius of 5 mm.

Referring to (b) of FIG. 11, the sheet resistance of the foldable transparent electrode based on fiber is almost constant, and the relative change of the sheet resistivity relative to the bending radius after a repetitive bending experiment of 10,000 cycles is within ~0.89%. However, it was found that the conventional ITO electrode had gradually increased sheet resistance, and there was no electrical signal after a repetitive bending experiment of ~270 cycles.

Accordingly, it was found that the foldable transparent electrode based on fiber according to the exemplary embodiment has excellent flexibility for maintaining performance in spite of extreme bending of a bending radius of 1 mm.

While the preferred exemplary embodiment of the present invention has been described above, the present invention is not limited thereto, and various modifications may be carried out within the claims, the detailed description of the invention, and the attached drawings, which also belongs to the scope of the present invention, of course.

The invention claimed is:

1. A manufacturing method of a foldable transparent electrode based on fiber, the method comprising:

coating a nylon-6 nanofiber nonwoven fabric having an optical transmittance of about 15% to about 66% with a polymer to prepare a nylon-6 nanofiber transparent thin film; and spin coating the nylon-6 nanofiber transparent thin film with a silver nanowire solution.

2. The method of claim 1, wherein a ratio of a refractive index of the polymer and a refractive index of the nylon-6 nanofiber nonwoven fabric is 0.964 to 0.998:1.

3. The method of claim 1, wherein the polymer includes poly(vinyl acetate), cellulose acetate or poly(acrylic acid).

4. The method of claim 1, wherein the spin coating of nylon-6 nanofiber transparent thin film with a nanowire includes:

forming an adhesive layer on the nylon-6 nanofiber transparent thin film; and spin coating the nanowire on the adhesive layer.

5. The method of claim 1, wherein a silver nanowire is contained at 0.025 wt % to 0.05 wt % in the silver nanowire solution.

6. A foldable transparent electrode based on fiber, manufactured by the method of claim 1.

* * * * *